US005766758A

United States Patent [19]

Hirakawa et al.

[11] Patent Number: 5,766,758

[45] Date of Patent: Jun. 16, 1998

[54] FIBER OF ETHYLENE-VINYL ALCOHOL COPOLYMER AND PROCESS FOR PRODUCTION THEREOF

[75] Inventors: Kiyoshi Hirakawa; Izumi Tabuchi; Yusuke Ando; Shinji Yamaguchi, all of Kurashiki, Japan

[73] Assignee: Kuraray Co., Ltd., Kurashiki, Japan

[21] Appl. No.: 820,092

[22] Filed: Mar. 19, 1997

[30] Foreign Application Priority Data

Mar. 27, 1996 [JP] Japan ..... 8-072301
Sep. 27, 1996 [JP] Japan ..... 8-255901

[51] Int. Cl.[6] ..... D02G 3/00; D06M 10/00

[52] U.S. Cl. ..... 428/364; 428/370; 428/373; 8/115.56

[58] Field of Search ..... 428/364, 370, 428/373, 374, 395; 525/57, 196, 223; 8/115.56, 115.61

[56] References Cited

U.S. PATENT DOCUMENTS 5,059,482 10/1991 Kawamoto et al. .
5,087,519 2/1992 Yamaguchi et al. .
5,340,650 8/1994 Hirakawa et al. .

*Primary Examiner*—Newton Edwards
*Attorney, Agent, or Firm*—Oblon, Spivak, McClelland, Maier & Neustadt, P.C.

[57] ABSTRACT

A fiber of ethylene-vinyl alcohol copolymer having a specific degree of crosslinking which is obtained by acetal decomposition regeneration reaction with a specific crosslinking agent. Because of its effective degree of crosslinking, this fiber has a greatly improved resistance to steam ironing and finds use for garments and living material.

7 Claims, 1 Drawing Sheet

FIBER OF ETHYLENE-VINYL ALCOHOL COPOLYMER AND PROCESS FOR PRODUCTION THEREOF

BACKGROUND OF THE INVENTION (1) Field of the Invention

The present invention relates to a fiber of ethylene-vinyl alcohol copolymer or a composite fiber containing said copolymer as one component, said fiber having good thermal stability which prevents it from sticking, between the fibers or excessive shrinkage due to dyeing at high temperatures, steam ironing, washing or drying. The present invention relates also to a process for producing and dyeing said fiber.

(2) Description of the Prior Art

Ethylene-vinyl alcohol copolymer obtained from ethylene-vinyl acetate copolymer by saponification can be made into a fiber which, owing to hydroxyl groups in its molecule, is superior to conventional synthetic fibers in hydrophilic nature, soil-resistant property, and protection against malodor. However, because of the copolymer's low melting point and softening point, this fiber suffers the disadvantage of being poor in thermal stability to hot water and steam. For this reason, there have been proposed several ideas for improvement by making said copolymer into composite fibers with other thermoplastic polymer such as polyester, polyamide, and polyolefin. The resulting composite fibers have improved dimensional stability. (See Japanese Patent Publication Nos. 5846/1981, 1372/1980, and 84681/1995.)

These ideas include a process of acetalizing the hydroxyl groups in said copolymer with a dialdehyde compound before contact with hot water for dyeing. Acetalized fiber protects itself against degradation in hand which occurs during dyeing at high temperatures and under high pressure, sewing, or steam-ironing due to partial softening or sticking of the exposed ethylene-vinyl alcohol copolymer on the surface of textile products such as woven fabric, knitted fabric, and non-woven fabric.

Unfortunately, acetalizing needs an additional step in dyeing and hence poses a problem with production cost. It also poses another problem with corrosion on equipment by concentrated acid for acetalizing, dyeing depth (insufficient diffusion of dye into acetalized fiber), color fading due to the dialdehyde compound remaining unreacted after acetalizing, and uniformity in fiber performance. Moreover, acetalizing presents difficulties in selecting an adequate dialdehyde compound and establishing an adequate degree of acetalizing from the industrial standpoint. In other words, acetalizing is not a practically established technology. At the present time, acetalizing is still in such a stage that the dyed fabric varies so much in color and hand depending on the degree of crosslinking that it is of low commercial value.

SUMMARY OF THE INVENTION

The present invention was completed to address the above-mentioned problem. Accordingly, it is an object of the present invention to provide a fiber of ethylene-vinyl alcohol copolymer superior in resistance to steam ironing. It is another object of the present invention to provide a composite fiber containing ethylene-vinyl alcohol copolymer as one component, which is capable of uniform dyeing in deep shade, is resistant to fading after dyeing, and has uniform fiber performance. It is further another object of the present invention to provide a process for producing said fibers simply and economically without problems with working environments. It is further another object of the present invention to provide a process for dyeing said fibers.

The gist of the present invention resides in a fiber of crosslinked ethylene-vinyl alcohol copolymer containing 25–70 mol % ethylene, characterized in that the effective degree of crosslinking (K%) represented by equation (1) below satisfies equation (2) below, and a composite fiber of ethylene-vinyl alcohol copolymer and other thermoplastic polymer, with said copolymer forming part of the fiber surface.

$$K(\%)=1.2\times\{(27+m)/35\}\times(T_{mk}-T_{mo}) \quad (1)$$

where, m denotes the number of linear methylene groups and/or methine groups in the crosslinked moiety;

$T_{mk}$ denotes the melting point (°C.) of the fiber of ethylene-vinyl alcohol copolymer measured after crosslinking, or the melting point of the ethylene-vinyl alcohol copolymer in the case of composite fiber;

$T_{mo}$ denotes the melting point (°C.) of the fiber of ethylene-vinyl alcohol copolymer measured before crosslinking, or the melting point of the ethylene-vinyl alcohol copolymer in the case of composite fiber;

$$K(\%)\geqq 0.27X+4.9 \quad (2)$$

where, x denotes the ethylene content (in mol %).

DESCRIPTION OF THE PREFERRED EMBODIMENT(s)

Figure 1:
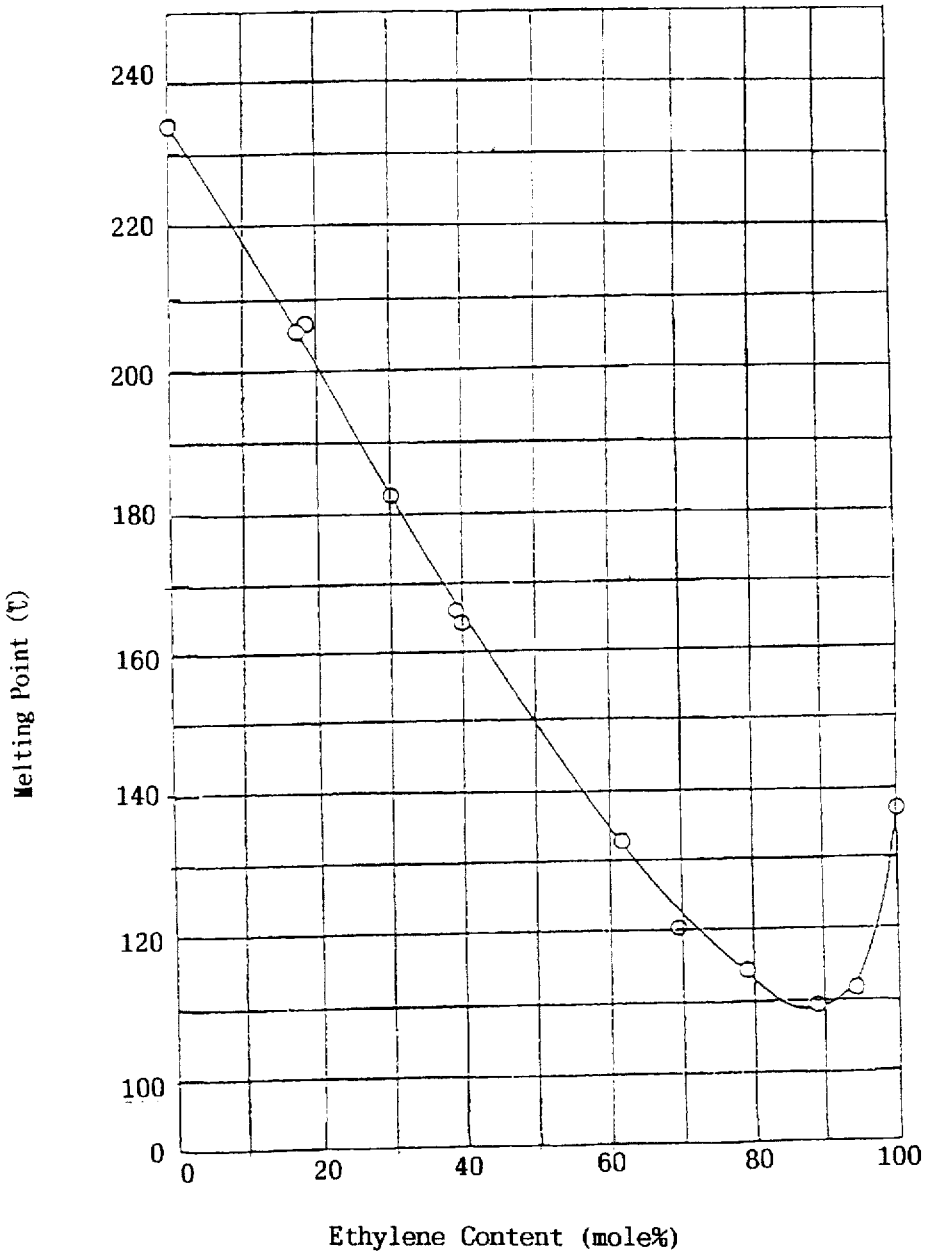
FIG. 1 is a graph showing the relation between the ethylene content (mol %) and the melting point of the fiber of the ethylene-vinyl alcohol copolymer which is not yet crosslinked.

A detailed description is given below of the ethylene-vinyl alcohol copolymer pertaining to the present invention. This copolymer is a saponification product of ethylene-vinyl acetate copolymer. It should contain ethylene in an amount of 25–70 mol %, preferably 30–50 mol %. As the content of ethylene increases (or the content of vinyl alcohol decreases), the content of hydroxyl groups decreases. As the result, the copolymer is poor in hydrophilic property and soil-resistant property. On the other hand, as the content of vinyl alcohol increases excessively, the copolymer is poor in spinnability and drawability at the time of melt spinning (leading to filament breakage and yarn breakage which are a hindrance to the streamlined production).

Another problem with a high content of vinyl alcohol in the copolymer is a difficulty in composite spinning with a thermoplastic polymer, such as polyester, having a high melting point. Such composite spinning necessarily needs a high spinning temperature. (This will be discussed later.)

An ethylene-vinyl alcohol copolymer has the property that its melting point measured by differential scanning calorimetry in the dry state shifts to the higher side in proportion to the content of vinyl alcohol. Likewise, the melting point ($T_{mo}$)of the fiber of ethylene-vinyl alcohol (before crosslinking) depends on the content of ethylene, as shown in FIG. 1. Consequently, it is expected that the melting point ($T_{mk}$) of the crystalline portion of the fiber (after crosslinking) also depends on the original content of ethylene. The ethylene content (×mol %) in the crystalline portion of the fiber of the crosslinked copolymer can be determined by X-ray diffractometry (using an X-ray imaging plate apparatus, Model DIPP 1000, and a software for polymer structure analysis system, both from Mac Science Co., Ltd.). Thus the melting point of the fiber of the copolymer before crosslinking that can be predicted from the ethylene content in the crystalline portion in the fiber of the copolymer after crosslinking coincides with the melting point of the fiber of the copolymer as shown in FIG. 1.

There is an established relationship between the melting point and the ethylene content in the case of composite fiber containing ethylene-vinyl alcohol copolymer as one component. It is possible to easily predict the melting point of the ethylene-vinyl alcohol copolymer in the composite fiber before crosslinking from the ethylene content and the composite ratio in the composite fiber after crosslinking.

According to the present invention, the fiber of crosslinked ethylene-vinyl alcohol copolymer (as mentioned above) can be obtained by treatment with a compound represented by formula (3) below.

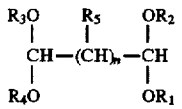

(3)

where $R_1$, $R_2$, $R_3$, and $R_4$ each denotes an alkyl group, or $R_1$ together with $R_2$ and $R_3$ together with $R_4$ form rings for alkylene groups, $R_5$ denotes hydrogen or an alkyl group, and n is a numeral in the range of 2 to 10. ($R_1$, $R_2$, $R_3$, $R_4$, and $R_5$ may have substituent groups.)

The alkyl groups represented by $R_1$ to $R_4$ in the formula should preferably be lower alkyl groups having 1 to 4 carbon atoms. Methyl group is most desirable for ease with which the compound can be used. These alkyl groups may be substituted by an alkylene oxy group such as ethylene oxy group. Alternatively, all of $R_1$, $R_2$, $R_3$, and $R_4$ are the same or different alkyl groups.

The alkylene group forming a ring should preferably be a lower alkylene group having 1 to4 carbon atoms. A 5- or 6-membered ring is preferable in view of the stability of the ring structure. In other words, an ethylene group and propylene group (having 2 to 3 carbon atoms) are desirable.

These alkyl groups and alkylene groups may have substituent groups.

In the case where more than one compound is used, "n" in the formula represents a value calculated from the compositional ratio and it is not necessarily an integer.

Said compound used for crosslinking should preferably be free from branched chains, and $R_5$ should preferably be hydrogen. However, said compound may be a mixture of a compound having a branched chain (with $R_5$ being a $C_{1-4}$ lower alkyl group) and a compound having no branched chains. If a fiber with good heat resistance is to be obtained, it is desirable to use a compound without branched chains or a mixture in which a compound without branched chains dominates.

In the case where $R_5$ denotes an alkyl group, as many alkyl groups as n can exist; however, in the present invention, it is not necessary that all of n $R_5$'s are alkyl groups. It is possible that some of them are alkyl groups and the remainder is hydrogen (in other words, the sum of the number of alkyl groups and the number of hydrogen atoms is n). The alkyl groups may be the same or different.

The above-mentioned compound is extremely stable because it has its terminals blocked with alkyl groups or alkylene groups forming a ring. Therefore, it does not oxidize upon contact with air (oxygen). Owing to the terminal blocking, this compound decomposes by itself into acetal even under a weak acid condition when exposed to a high temperature under high pressure. The resulting acetal takes part in the acetalizing reaction with water-swollen ethylene-vinyl alcohol copolymer having hydroxyl groups. The acetal exchange reaction (crosslinking reaction) involving dealcoholization will be referred to as acetal decomposition regeneration reaction hereinafter.

It has been common practice to perform crosslinking on ethylene-vinyl alcohol copolymer in a strong acid condition (such as 1–2N sulfuric acid), as disclosed in Japanese Patent Laid-open No. 17015/1991. By contrast to this prior art technology, the present invention is designed to perform the acetal decomposition regeneration reaction (involving dealcoholization) in a weak acid condition. In other words, the crosslinking of ethylene-vinyl alcohol copolymer in the present invention is not a simple reaction.

The acetal decomposition regeneration reaction imparts dimensional stability, resistance to steam-ironing, and resistance to soil redeposition to the fiber of ethylene-vinyl alcohol copolymer. It also imparts heat resistance at the time of dyeing at a high temperature, resistance to steam-ironing, uniform dyeability, and good hand to the composite fiber of ethylene-vinyl alcohol copolymer and other thermoplastic polymer. For the crosslinking to produce a practical effect, it is necessary to take the effective degree of crosslinking into account.

The degree of crosslinking is usually defined as the ratio of the actual weight increase (due to reaction) to the theoretical weight increase (100) that would occur if all the hydroxyl groups in the ethylene-vinyl alcohol copolymer are acetalized. However, in the present invention, the effective degree of crosslinking is used instead of the degree of crosslinking in the usual sense, because the above-mentioned effect is closely related with the length of the crosslinked moiety and the internal structure of the fiber. According to the present invention, the effective degree of crosslinking is defined by the melting point of the crystalline moiety. (The melting point indicates a state in which crystals are bound.)

According to the present invention, the effective degree of crosslinking is defined by equation (1) above, in which m denotes the number of linear methylene groups and/or methine groups in the crosslinked moiety;

$T_{mk}$ denotes the melting point (°C.) of the fiber of ethylene-vinyl alcohol copolymer measured after crosslinking, or the melting point of the ethylene-vinyl alcohol copolymer in the case of composite fiber; and $T_{mo}$ denotes the melting point (°C.) of the fiber of ethylene-vinyl alcohol copolymer measured before crosslinking, or the melting point of the ethylene-vinyl alcohol copolymer in the case of composite fiber. ($T_{mo}$ is predictable from the content of ethylene in the crystalline moiety as mentioned above.) The term "linear" means the linkage between the two carbon atoms having $OR_{1-4}$ shown in formula (3).

The number (m) of linear methylene groups and/or methine groups in the crosslinked moiety plays an important role in the properties of textile products, such as dimensional stability, resistance to soil redeposition, resistance to excessive shrinkage and sticking; due to hot water or steam ironing, uniform dyeability, and good hand. Thus the number (m) in equation (1) is a measure of the effective degree of crosslinking. If two samples have the same value of $T_{mk}-T_{mo}$, the one having a larger value of m is more sensitive to crosslinking. A sample with a small value of m needs the acetal decomposition regeneration reaction to be carried out in a severe condition using a strong acid which corrodes the stainless steel kettle for dyeing. This restricts the industrial use of the present invention to produce the above-mentioned effect. The value of m should be 2 or above, preferably 4 or above. Any operation that results in a value of m larger than 10 is industrially undesirable because the compound for crosslinking is expensive and is hardly dispersible into water (for emulsification). Such operation is impracticable for the acetal decomposition regeneration reaction. In addition, such operation tends to yield more oligomer during the acetal decomposition regeneration reaction.

The value of m can be obtained by performing liquid chromatography on a sample (a crosslinked fiber obtained by the acetal decomposition regeneration reaction) after deacetalizing reaction to release the compound (aldehyde) used for the acetal decomposition regeneration reaction.

It is necessary that the effective degree of crosslinking (K) satisfy equation (2). In other words, the effective degree of crosslinking (K) is closely related with the content of ethylene in the ethylene-vinyl alcohol copolymer. The copolymer crosslinked such that the effective degree of crosslinking (K) satisfies equation (2) produces the above-mentioned effects (i.e., dimensional stability, resistance to soil redeposition, and excessive shrinkage and hang-up by hot water and steam ironing).

The ethylene-vinyl alcohol copolymer undergoes anomalous shrinkage upon heating by hot water or steam ironing which relaxes the molecular strain of the copolymer. To prevent such shrinkage, it is necessary to disturb the molecular orientation by crosslinking to such an extent that the orientation coefficient (defined below) is lower than 0.19.

$$\text{Orientation coefficient}=2\cdot(1-D)/(D+2) \quad (4)$$

where D denotes the ratio of the integrated intensity of PAS of polarized light perpendicular to the fiber axis to the integrated intensity of PAS of polarized light parallel to the fiber axis.

The orientation coefficient can be measured and calculated by using a polarized PAS (photoacoustic spectroscopy), which is an FTIR (Fourier transform infrared absorption spectroscopy) equipped with a PAS unit and a polarizing plate. The orientation is evaluated in terms of the dichroic ratio of the bands perpendicular to the axis of the molecular chain. Such bands are those due to symmetric stretch of methylene ($CH_2$), antisymmetric stretch of methylene ($CH_2$), and stretch of methine (CH). Since these bands overlap in the vicinity of 2800–2980 $cm^{-1}$, calculations are carried out in terms of the total integrated intensity of the three bands. The dichroic ratio is expressed in terms of the value obtained by diving the integrated intensity of PAS of polarized light parallel to the fiber axis by the integrated intensity of PAS of polarized light perpendicular to the fiber axis. The orientation coefficient is calculated by equation (4).

The acetal decomposition regeneration reaction is affected by the concentration of an acid used as a catalyst. This is demonstrated by an experiment explained below. A composite fiber containing ethylene-vinyl alcohol copolymer as one component was treated (for crosslinking) at 100° C. with 1,1,9,9-tetramethoxynonane as the compound represented by formula (3) above in the presence of sulfuric acid (as a catalyst) varying in concentration as follows.

(1) 15 g/liter (0.33N, pH=1.15)

(2) 2.25 g/liter (0.05N, pH=1.65)

(3) 0.9 g/liter (0.018N, pH=1.9)

The increase in melting point due to crosslinking was greater than 20° C. regardless of the acid concentration; however, the samples of crosslinked fibers greatly differed in color development depending on the acid concentration although they were the same in other properties (i.e., excessive shrinkage and sticking.). In other words, the higher the acid concentration, the poorer the color development.

A probable reason for the difference in color development is that the acetal decomposition regeneration reaction proceeds excessively from the surface of the fiber if the acid concentration is excessively high. The result is that the density of crosslinking is higher in the outer layer of the fiber than in the inner layer of the fiber. This difference gives rise to the so-called skin-core structure.

The acetal decomposition regeneration reaction proceeds fast in a condition of high acid concentration, resulting in a high effective degree of crosslinking in fiber. However, the orientation coefficient tends to decrease with the increasing effective degree of crosslinking.

The effective degree of crosslinking is important in the present invention, but it should be well balanced with the orientation coefficient. Therefore, the present invention requires that the effective degree of crosslinking satisfies equation (2) and the orientation coefficient is 0.19 or below, preferably 0.16 or below.

Although the above-mentioned condition for the effective degree of crosslinking is essential in the present invention, the orientation coefficient can be 0 without any problem with fiber properties for practical use.

The object of satisfying the condition for the effective degree of crosslinking can be achieved by lowering the acid concentration in the acetal decomposition regeneration reaction or by lowering the speed of heating until the substantial treatment temperature is reached or by reducing the reaction rate in the reactor. These means permit uniform, reproducible processing.

If the effective degree of crosslinking exceeds the above-mentioned limit, the resulting fiber is poor in color development and wash fastness and is subject to anomalous shrinkage upon treatment with hot water or steam.

The term "acetal decomposition regeneration reaction" as used in the present invention denotes a state in which reaction has taken place between the ethylene-vinyl alcohol copolymer and all or at least one of the $OR_{1-4}$ groups in the compound represented by formula (3).

The ethylene-vinyl alcohol copolymer involved in the present invention can be produced by any known process. A typical process consists of performing radical polymerization on ethylene and vinyl acetate in a solvent (such as methanol) in the presence of a catalyst, discharging unreacted monomers, saponifying the resulting polymer with sodium hydroxide for conversion into an ethylene-vinyl alcohol copolymer, pelletizing the copolymer under water, and washing and drying. A disadvantage of this process is that the resulting copolymer is liable to contamination with alkali metal or alkaline earth metal in an amount more than hundreds of ppm. The amount of such contaminants (metal ions) should be less than 100 ppm, particularly less than 50 ppm because they make the copolymer vulnerable to thermal decomposition. One way of reducing contaminants is by washing wet pellets with a large amount of pure water containing acetic acid and subsequent washing with a large excess of pure water alone.

It is also possible to produce the ethylene-vinyl alcohol copolymer by saponifying an ethylene-vinyl acetate copolymer with sodium hydroxide. The degree of saponification should preferably be higher than 95%. With an excessively low degree of saponification, the copolymer is low in crystallinity and is poor in fiber basic properties (such as strength). Moreover, the copolymer is liable to softening and hence to troubles in processing, with the result that the resulting fiber and textile product are poor in hand.

According to the present invention, the copolymer may be formed into fiber alone or in combination with any other thermoplastic polymer, as mentioned above. Examples of such thermoplastic polymers are crystalline ones, such as polyester, polyamide, and polypropylene, which have a melting point higher than 150° C. and hence are desirable from the standpoint of heat resistance and dimensional stability.

The polyester include those fiber-forming polyesters which are composed of an aromatic dicarboxylic acid (such as terephthalic acid, isophthalic acid, naphthalene-2,6-dicarboxylic acid, phthalic acid, α,βp-(4-carboxyphenoxy) ethane, 4,4'-dicarboxydiphenyl, and sodium 5-sulfoisophthalate), aliphatic dicarboxylic acids or esters thereof (such as azelaic acid, adipic acid, and sebacic acid), and diols (such as ethylene glycol, diethylene glycol, 1,3-propane diol, 1,4-butanediol, 1,6-hexandiol, neopentyl glycol, cyclohexane-1,4-dimethanol, polyethylene glycol, and polytetramethylene glycol). Preferred polyesters are those in which more than 80 mol % of the constituent units is accounted for by ethylene terephthalate units or butylene terephthalate units. The polyester may contain a small amount of additives, such as fluorescent brightener, delustering agent, UV light absorber, coloring agent, and flame retardant.

The polyamide includes aliphatic polyamides composed mainly of nylon 6, nylon 66, or nylon 12 and semiaromatic polyamides. They may contain a small amount of third component. They may contain a small amount of additives, such as fluorescent brightener, delustering agent, UV light absorber, coloring agent, and flame retardant.

In the case of composite fiber composed of the ethylene-vinyl alcohol copolymer and any other thermoplastic polymer, the ratio of the former to the latter should preferably be 10:90 to 90:10 (by weight) for good spinnability. The composite form is not specifically restricted; it includes eccentric sheath-core type, laminated type, side-by-side type, and random composite type. For the composite fiber to exhibit good hydrophilic nature and hand inherent in the ethylene-vinyl alcohol copolymer, it is necessary that the ethylene-vinyl alcohol copolymer constitute at least part (preferably more than 30%) of the peripheral length of the cross section of the composite fiber.

According to the present invention, even in the case of the composite fiber mentioned above, the ethylene-vinyl alcohol copolymer constituting the composite fiber is also characterized by that the effective degree of crosslinking (K) represented by equation (1) satisfies equation (2) below.

$$K(\%)=1.2\times\{(27+m)/35\}\times(T_{mk}-T_{mo}) \quad (1)$$

where, m denotes the number of linear methylene groups and/or methine groups in the crosslinked moiety of the copolymer;

$T_{mk}$ denotes the melting point (°C.) of the copolymer portion in the composite fiber measured after crosslinking; and $T_{mo}$ denotes the melting point (°C.) of the copolymer portion of the composite fiber measured before crosslinking.

$$K(\%)\geqq 0.27X+4.9 \quad (2)$$

where, x denotes the ethylene content (in mol %).

The value of m can be obtained by performing liquid chromatography on a sample (a composite fiber obtained by the acetal decomposition regeneration reaction) after deacetalizing reaction to release the compound (aldehyde) used for the acetal decomposition regeneration reaction. The melting point of the ethylene-vinyl alcohol copolymer constituting the composite fiber can be measured by differential scanning calorimetry (DSC) while keeping the shape of the composite fiber intact. The orientation coefficient can also be measured while keeping the shape of the composite fiber intact.

A detailed description is given below of the method for performing crosslinking (or the acetal decomposition regeneration reaction) on the fiber of ethylene-vinyl alcohol copolymer or the composite fiber composed of said copolymer and any other thermoplastic polymer.

Polymers having hydroxyl groups (such as polyvinyl alcohol and ethylene-vinyl alcohol copolymer) are usually acetalized (or crosslinked) with dialdehyde (such as glutalaldehyde, glyoxal, and nonanedial) for improvement in hot water resistance, as mentioned above. A disadvantage of this practice is that the dialdehyde is subject to oxidation by air and easily changes with time. Therefore, acetalization with the dialdehyde is inefficient and poor in yields. In addition, the dialdehyde has an irritating odor peculiar to aldehyde, posing a problem with working environment. Moreover, when used simultaneously with dyeing, the dialdehyde deteriorates the dye because of the reducing property of the aldehyde group, with the result that the dyed product is poor in light fastness.

In the present invention, this problem was completely solved by using the compound represented by formula (3) above as a crosslinking agent for acetalization (or crosslinking). This compound is only slightly soluble in water but can be used in the form of aqueous emulsion by the aid of a nonionic surface active agent such as sodium dodecylbenzenesulfonate and sodium salt of oxyalkylene-modified sulfonic acid of polycyclic phenol. It may also be dissolved in a water-alcohol mixed solvent.

The concentration of the compound should be 10–40 wt %, preferably 15–30 wt %, for the amount of the ethylene-vinyl alcohol copolymer to be treated.

The compound should preferably be used in combination with an inorganic salt composed of a strong acid and a strong base (typically sodium sulfate for general adaptability), which controls the rate of acetal decomposition regeneration reaction or suppresses the hydrolysis of a dye in the case where the compound is used simultaneously with dyeing.

An adequate degree of crosslinking may be obtained according to the present invention by using a strong acid (such as sulfuric acid) as a catalyst for the acetal decomposition regeneration reaction. In this case, the concentration of the acid should preferably be lower than 0.05 normal.

It is possible to control the acidity of the reaction system by the aid of a mineral acid (such as hydrochloric acid and sulfuric acid) and an organic acid (such as acetic acid, formic acid, maleic acid, tartaric acid, lactic acid, citric acid, malic acid, and succinic acid). An organic acid is preferable because of its non-corrosive properties. These water-soluble acids may be replaced by solid acids (such as activated clay and ion-exchange resin).

With a pH value lower than 1.0, the treating solution causes crosslinking to take place preferentially on the outermost layer of the fiber being treated. This is not desirable for the effective degree of crosslinking. In addition, it poses a problem with coloring or yellowing of the fiber. In the case of simultaneous dyeing (mentioned later), it poses a problem with discoloration or poor light fastness of the fiber.

On the other hand, with a pH value higher than 5.0, the treating solution is slow in the acetal decomposition regeneration reaction unless the treating temperature is raised or the treating time is extended. The slow reaction does not give rise to the crosslinked fiber having good hand and good hot water resistance as intended. A pH value in the range of 2.0 to 4.0 is desirable for the acetal decomposition regeneration reaction and the protection of dye from deterioration.

For the effective degree of crosslinking (K) represented by equation (1) to satisfy equation (2), it is necessary that the treating temperature be in the range of 100° C. to 140° C. preferably 110° C. to 135° C. If the treating temperature is lower than 100° C. (with pH in the range mentioned above), the acetal decomposition regeneration reaction is extremely slow and the effective degree of crosslinking is low, with the result that the resulting textile product is poor in hand and resistance to hot water and steam-ironing. In contrast, treatment at a temperature higher than 140° C. results in a textile product which is stiff and poor in hand due to excessive fiber shrinkage.

In the present invention, the effective degree of crosslinking is important for the fiber or composite fiber of ethylene-vinyl alcohol copolymer to have desirable properties, such as freedom from sticking, and excessive shrinkage during dyeing at high temperature, steam ironing, laundering, and drying, and uniform crosslinking, and stable productivity. This has been mentioned above.

It is difficult to precisely describe the structure of the fiber in the present invention because microstructurewise the crosslinked portion is amorphous. Textile products often vary in hand even though they have the same degree of crosslinking calculated from weight increase due to crosslinking. This is a problem with producing uniform textile products.

In view of this, the present inventors investigated how the increase in melting point after crosslinking is affected by the number of the linear methylene groups and/or methine groups in the crosslinking compound represented by formula (3). As the result, it was found that the effect of crosslinking is proportional to the number of the linear methylene groups and/or methine groups in the crosslinking compound even though the increase in melting point due to crosslinking is small, as shown in equation (1). It was also found that the above-mentioned effect is produced if a specific relation is established between the effective degree of crosslinking and the ethylene content in the ethylene-vinyl alcohol copolymer.

In the present invention, the above-mentioned acetal decomposition regeneration reaction may be preceded by dry heat treatment at a temperature lower than the melting point of the fiber of the ethylene-vinyl alcohol copolymer or the composite fiber of said copolymer with any other thermoplastic polymer so that the fiber or composite fiber is much improved in hot water resistance. This dry heat treatment should preferably be carried out at a temperature which is 5°–20° C. lower than the melting point of the copolymer. A probable reason for the effect of dry heat treatment is that dry heat treatment promotes the crystallization of the microstructure of the copolymer and the introduction of crosslinking by the acetal decomposition regeneration reaction restrains the molecular motion. Thus, the resulting crosslinking prevents the fiber from softening and sticking due to ironing (during sewing) and steam ironing.

The acetal decomposition regeneration reaction with the compound represented by formula (3) above under a specific condition imparts greatly improved hot-water resistance to the fiber of ethylene-vinyl alcohol copolymer or the composite fiber of said copolymer with any other thermoplastic polymer. It also produces additional effect if it is performed simultaneously with dyeing. The resulting textile product is capable of decolorization and redyeing for color change. (This technique is applicable to textile products with light color as well as dark color and is effective particularly for the composite fiber of the copolymer with a thermoplastic polymer such as polyamide and polyester.) However, there is an instance where the dye is decomposed by a certain kind of acid used as a catalyst for the acetal decomposition regeneration reaction. In such a case, two-stage dyeing may be necessary.

The effect of performing the acetal decomposition regeneration reaction simultaneously with dyeing is the reduced shrinkage and the capability of deep shade coloring owing to the cross linkage introduced simultaneously with the diffusion and deposition of dye molecules. In the case of deep shade dyeing, the acetal decomposition regeneration reaction that follows dyeing is not desirable because it causes discoloration.

The above-mentioned means is effective for deep shade dyeing of the fiber of ethylene-vinyl alcohol copolymer or the composite fiber in which said copolymer constitutes the sheath. It is also applicable to composite fiber of other construction or to pale shade dyeing.

The simultaneous crosslinking and dyeing are effective also for the simplification of process.

Incidentally, acetalization with a conventional dialdehyde cannot be performed simultaneously with dyeing in the case of deep shade dyeing because it vigorously decomposes the dye. If a disperse dye is used in the case of crosslinking simultaneous with dyeing, it is desirable to adjust the system to pH 2.0–4.0 with an acid (such as maleic acid and acetic acid) or ammonium acetate to protect it from hydrolysis. An inorganic salt (such as sodium sulfate and sodium chloride) is effective in preventing a disperse dye from hydrolysis.

The combined use of β-naphthalenesulfonic acid-formaldehyde condensate known as a crosslinking promoting agent enhances the effect of improving hot-water resistance.

The treatment according to the present invention may be performed on fibers as well as fabric (such as woven fabric, knitted fabric, and non-woven fabric). The treatment on fabrics is desirable because of its ease and convenience.

The fiber or composite fiber pertaining to the present invention may be in the form of staple fiber or filament yarn. The former includes staple for garment cloth and non-woven fabrics (by dry, wet, or wet-thermal process). The fiber or composite fiber may be used alone or in combination with other fibers. Needless to say, there is a certain limit of mixing ratio for the resulting textile product to produce the effect of the present invention.

If used in the form of filament yarn, the fiber or composite fiber pertaining to the present invention is suitable for underwear, uniform, sanitary gown, and outer garment on account of its good color development and good hand.

The fiber or composite fiber of the present invention may also be used for curtain and wall covering.

The fiber or composite fiber pertaining to the present invention may undergo false twist crimping so that the finished fiber has a polygonal cross section (such as pentagon or hexagon). It may also be produced by spinning from a nozzle of modified cross-section so that the resulting fiber has a special cross section such as multifoliate (3- to 8-foliate) pattern or T- or U-shaped pattern.

EXAMPLES

To further illustrate the invention, and not by way of limitation, the following examples are given. Characteristic properties in the examples were measured by the following methods.

(1) Orientation coefficient of fiber

Calculated by equation (4) from the ratio of the integrated intensity of PAS of polarized light parallel to the fiber axis to the integrated intensity of PAS of polarized light perpendicular to the fiber axis.

(2) Ratio of acetalizing reaction (%)

Calculated by the equation below.

$$\text{Ratio of acetalizing reaction (\%)}=\{(W-W_0)/x\}\times 100$$

where x is the concentration (%owf) of the crosslinking agent; W is the absolute dry weight of the dyed fabric (with crosslinking) measured after removal of dye; and $W_0$ is the absolute dry weigh of the fabric measured before dyeing and crosslinking. (To determine W, the sample is extracted with 57% aqueous solution of pyridine using a Soxhlet apparatus for removal of dye and then the sample is dried at 70° C. under reduced pressure (0.1 mmHg) for 15 hours. To determine $W_0$, the sample (not yet dyed and crosslinked) is dried at 70° C. under reduced pressure (0.1 mmHg) for 15 hours.)

(3) Melting point of fiber (°C.)

Measured by differential scanning calorimetry (DSC) and expressed in terms of endothermic peak temperature.

Measuring conditions: the sample is allowed to stand at 30° C. for 3 minutes and then heated to 220° C. at a rate of 10°C./min. Incidentally, the melting point of the uncrosslinked sample was obtained from the calibration curve (FIG. 1) in which the melting point is plotted against the ethylene content in the crosslinked fiber determined by X-ray diffractometry. In the case of composite fiber, the peak at the low-temperature side was regarded as the melting point of ethylene-vinyl alcohol copolymer.

(4) Dimensional change (%)

The sample is rated as good if no change in dimension is visually observed when the sample before and after crosslinking is washed at 90° C. (in the industrial standard manner for sanitary gown).

(5) Resistance to soil redeposition (class)

The sample is examined according to JIS L-0805 (gray scale for soiling) and JIS L-0810 (environment) after washing at 90° C. (in the industrial standard manner for sanitary gown).

(6) Hyperchromic effect

Expressed in terms of the L* value calculated according to equation below from the tristimulus values (X, Y, Z) and the chromaticity coordinates (x, y).

$$L^*=116\,(Y/100)^{1/3}-16$$

The tristimulus values are obtained from the spectral reflectance of the dyed sample measured according to JIS Z-8722 by using a color analyzer (spectrophotometer C-2000S). The lower the L* value, the better the hyperchromic effect.

(7) Degree of exhaustion (%)

Calculated according to the equation below from the absorbance of the dye solution (diluted with a 1:1 (by volume) acetone/water mixture) measured before and after dyeing.

$$\text{Degree of exhaustion (\%)}=\{(A-B)/B\}\times 100$$

where A is the absorbance at the maximum absorption wavelength of the diluted dye solution measured before dyeing, and B is the absorbance at the maximum absorption wavelength of the diluted dye solution measured after dyeing.

(8) Light fastness

Evaluated according to JIS L-0842 (the second exposure method).

(9) Resistance to steam ironing

Evaluated in terms of press shrinkage according to JIS L-1042 NI (Method H-3). The criteria for evaluation are as follows.

good: no sticking and shrinkage at all.

poor: slight sticking bad: excessive sticking and shrinkage to make the sample stiff.

Examples 1 to 6 and Comparative Examples 1 to 4

A random copolymer containing ethylene (in an amount as shown in Table 1) was prepared from ethylene and vinyl acetate by radical polymerization at 60° C. or below in methanol (as a solvent). The copolymer underwent saponification with sodium hydroxide. Thus there was obtained an ethylene-vinyl alcohol copolymer having a degree of saponification higher than 99%. The resulting copolymer (in wet state) was rinsed repeatedly with a large excess of pure water containing a small amount of acetic acid and then rinsed repeatedly with a large excess of pure water so as to reduce the content of alkali metal ions and alkaline earth metal ions in the copolymer to about 10 ppm or less. The rinsed copolymer was dewatered by using a dehydrator and then completely vacuum-dried at 100° C. or below.

The copolymer was found to have a degree of polymerization in a range of 600 to 1000.

The copolymer was subjected to extrusion melt-spinning at a rate of 1000 m/min, with the spinneret temperature being 260° C. The emergent filaments were drawn in the usual way. Thus there was obtained a multifilament yarn (75 denier/24 filaments).

A plain weave (1/1) was prepared from the multifilament yarn as the warp and weft. The plain weave was desized at 80° C. for 30 hours using an aqueous solution containing sodium hydroxide (1 g/liter) and Actinol R-100 from Matsumoto Yushi Seiyaku Co., Ltd. (0.5 g/liter). The desized fabric was dipped in the treating solution (specified below) for acetal decomposition regeneration reaction. The dipping was followed by reduction and washing.

Treating solution

Treating agent:

tetramethoxynonane, 5 g/liter

"Labasion" from Matsumoto Yushi Co., Ltd. (containing sodium dodecylbenzenesufonate as an active ingredient), 0.5 g/liter (pH adjusted with acetic acid, sulfuric acid, formic acid, or maleic acid)

Bath ratio: 50:1

Treating time: 40 minutes at 130° C.

Reduction and washing

| | |
|---|---|
| Sodium hydrosulfite | 1 g/liter |
| sodium hydroxide | 1 g/liter |
| "Amiradine D" | 1 g/liter |

(from Dai-ichi Kogyo Seiyaku Co., Ltd.) 20 minutes at 80° C.

Table 1 shows the pH and temperature at which the acetalizing treatment was carried out and the results of evaluation.

It is apparent from Table 1 that the treated samples greatly vary in the effective degree of cross-linking depending on the treating condition seven though the treatment is carried out with the same tetramethoxynonane. Those fiber samples which do not conform to the present invention are unsatisfactory because of large dimensional change (after industrial washing at 90° C.), stiff hand, and sticking by steam ironing at 160° C.

Comparative Example 5

The same procedure as in Example 3 was repeated except that the tetramethoxynonane (for acetal decomposition regeneration reaction) was replaced by glutaraldehyde (5 g/liter). Table 1 shows the pH and temperature at which the acetalizing treatment was carried out and the results of evaluation.

It is noted that the ratio of acetalization is very low and the treated fiber has a low effective degree of cross-linking and suffers stiff hand and sticking due to steam ironing at 120° C.

Comparative Example 6

The same procedure as in Example 1 was repeated except that the treating solution was replaced by the one specified below. The resulting fabric sample was evaluated. The results are shown in Table 1. It is noted that the ratio of acetalization is very low and the treated fiber has a low effective degree of cross-linking and suffers stiff hand and sticking due to steam ironing at 160° C.

Treating solution

Treating agent:

nonanedial, 3 g/liter

"Labasion" from Matsumoto Yushi Seiyaku Co., Ltd. (containing sodium dodecylbenzenesufonate as an active ingredient), 0.5 g/liter (pH adjusted with acetic acid)

Bath ratio: 50:1

Treating time: 40 minutes at 130° C.

Reduction and washing

| | |
|---|---|
| Sodium hydrosulfite | 1 g/liter |
| sodium hydroxide | 1 g/liter |
| "Amiradine D" | 1 g/liter |

(from Dai-ichi Kogyo Seiyaku Co., Ltd.) 20 minutes at 80° C.

Comparative Example 7

The same procedure as in Example 1 was repeated except that the tetramethoxynonane was replaced by tetramethoxypropane (3.1 g/liter). The results are shown in Table 1.

It is noted that the ratio of acetalization is very low and the treated fiber has such a low effective degree of crosslinking (which does not meet the requirement of the present invention) that it suffers stiff hand due to sticking at high temperatures although it withstands steam ironing at 120° C.

Comparative Example 8

The same procedure as in Comparative Example 7 was repeated except that the treating solution was adjusted to pH 2.0. It was found that the sample rather decreased in melting point because of excessive acetalization which destroyed the crystalline phase, increasing the amorphous phase. As the result, the sample was stiff in hand due to sticking and shrinkage by steam ironing at 120° C.

TABLE 1

| Example (Comparative Example) | Ethylene content (mol %) | Acetal decomposition regeneration reaction: Treating agent | Add catalyst | pH | Temperature (°C.) | Rate of reaction (%) | Melting point (°C.): Before cross-linking | After cross-linking | Effective degree of cross-linking (%) | Orientation coefficient |
|---|---|---|---|---|---|---|---|---|---|---|
| 1 | 32 | TMN | A.A. | 3.5 | 130 | 80 | 183 | 195 | 14.0 | 0.188 |
| 2 | 32 | TMN | F.A. | 2.7 | 130 | 85 | 183 | 198 | 17.5 | 0.174 |
| 3 | 32 | TMN | S.A. | 2.0 | 130 | 90 | 183 | 205 | 25.6 | 0.085 |
| 4 | 32 | TMN | M.A. | 2.4 | 125 | 88 | 183 | 203 | 23.3 | 0.101 |
| 5 | 45 | TMN | S.A. | 2.0 | 115 | 80 | 163 | 182 | 22.1 | 0.135 |
| 6 | 55 | TMN | S.A. | 2.0 | 110 | 65 | 147 | 168 | 24.5 | 0.112 |
| (1) | 32 | TMN | S.A. | 5.5 | 130 | 30 | 183 | 187 | 4.6 | 0.248 |
| (2) | 32 | TMN | S.A. | 2.0 | 80 | 40 | 183 | 191 | 9.3 | 0.205 |
| (3)* | 32 | TMN | S.A. | 2.0 | 145 | 95 | 183 | — | 0 | 0 |
| (4)** | 20 | TMN | — | — | — | — | — | — | — | — |
| (5) | 32 | GA | S.A. | 2.0 | 130 | 38 | 183 | 192 | 9.8 | 0.231 |
| (6) | 32 | NL | A.A. | 3.5 | 130 | 50 | 183 | 190 | 9.2 | 0.239 |
| (7) | 32 | TMP | A.A. | 3.5 | 130 | 24 | 183 | 194 | 11.4 | 0.222 |

| Example (Comparative Example) | Washing at 90° C.: Change in dimensions | Change in hand | Soil redeposition | Steam ironing: 120° C. | 160° C. | 180° C. |
|---|---|---|---|---|---|---|
| 1 | good | good | 5–4 | good | good | good |
| 2 | good | good | 5–4 | good | good | good |
| 3 | good | good | 5 | good | good | good |
| 4 | good | good | 5 | good | good | good |
| 5 | good | good | 5 | good | good | fair |

TABLE 1-continued

| | | | | | | |
|---|---|---|---|---|---|---|
| 6 | good | good | 5–4 | good | fair | poor |
| (1) | poor | sticking | 5–4 | good | bad | worst |
| (2) | poor | sticking | 5–4 | good | bad | worst |
| (3)* | — | — | — | — | — | — |
| (4)** | — | — | — | — | — | — |
| (5) | good | good | 4 | poor | poor | bad |
| (6) | good | good | 4 | fair | poor | bad |
| (7) | good | good | 4 | good | poor | bad |

*The sample was not evaluated because it was too stiff in hand to be of practical use.
**The sample was not spinnable.
TMN: tetramethoxynonane
GA: Glutaldehyde
NL: nonanediol
TMP: tetramethoxypropane
A.A.: acetic acid
F.A.: formic acid
M.A.: maleic acid
S.A.: sulfuric acid

Examples 7 and 8

A composite fiber of sheath-core type was prepared from component A (for sheath) and component B (for core) defined below, with the ratio of A/B being 1/1.

Component A: Ethylene-vinyl alcohol copolymer (in the form of chips), containing 32 mol % ethylene and having a degree of saponification of 99% and a melting point of 181° C.

Component B: Polyethylene terephthalate (in the form of chips), containing 10 mol % of isophthalic acid and having an intrinsic viscosity of 0.65, measured at 30° C. in a 1/1 phenol/tetrachloroethane mixture (by weight).

The spinning temperature was 250° C. and the winding speed was 1000 m/min.

The spun filaments were drawn three times in the usual way by using a hot roll (at 75° C.) and a hot plate (at 140° C.). Thus there was obtained a composite multifilament yarn, 50 denier/24 filaments.

A satin crepe was woven from this yarn as the warp (Z-twist 300 T/m) and weft (Z-twist 2500 T/m and S-twist 2500 T/m), with alternate beating of two wefts. The gray fabric has a density of 185 warps/30 mm and 98 wefts/30 mm.

In Example 7, the gray fabric underwent scouring and then underwent acetal decomposition regeneration reaction (with the treating solution specified below) and dyeing simultaneously, followed by reduction and washing. Final setting was performed at 170° C.

In Example 8, the gray fabric underwent dry heat treatment at 170° C. without tension and then scouring and further underwent acetal decomposition regeneration reaction (under the conditions specified below) and dyeing simultaneously, followed by reduction and washing and final setting.

The resulting two finished fabrics were evaluated. The results are shown in Table 2.

| | | |
|---|---|---|
| Scouring: | soda ash | 2 g/liter |
| | "Actinol R-100" | 0.5 g/liter |

(from Matsumoto Yushi Seiyaku Co., Ltd.) at 90° C. for 30 minutes

Treating solution

Treating agent:

| | | |
|---|---|---|
| | tetramethoxynonane | 5 g/liter |
| | "Labasion" | 0.5 g/liter |

from Matsumoto Yushi Co., Ltd. (containing sodium dodecylbenzenesufonate as an active ingredient)

| | | |
|---|---|---|
| Dye stuff: | DIANIX TUXED BLACK HCONC PAST | 15% owf |
| | "Disper TL" | 1 g/liter |

(from Weisei kagaku kogyo Co., Ltd.)

(pH adjusted with acetic acid, sulfuric acid, or formic acid)

Bath ratio: 50:1

40 minutes at 135° C. (liquor stream at high temperatures)

Reduction and washing

| | |
|---|---|
| Sodiumu hydrosulfite | 1 g/liter |
| sodium hydroxide | 1 g/liter |
| "Amirdine D" | 1 g/liter |

(from Dai-ichi Kogyo Seiyaku Co., Ltd.)

20 minutes at 80° C.

Comparative Example 9

The same procedure as in Example 8 was repeated except that the tetramethoxynonane (as the acetalizing agent) was replaced by nonanedial (3 g/liter). No satisfactory dyeing was achieved because the dye was decomposed by the acid. The resulting fabric was too poor in light fastness to be of practical use.

Example 9

The same procedure as in Example 8 was repeated except that the tetramethoxynonane (as the acetalizing agent) was replaced by 1,1,9,9-bisethylenedioxynonane (5 g/liter). The dyed fabric underwent dry heat treatment at 160° C. for final setting. The results are shown in Table 2.

TABLE 2

| | | Acetal decomposition regeneration reaction | | | | | | | | | Evaluation of dyed fabric | | | | |
|---|---|---|---|---|---|---|---|---|---|---|---|---|---|---|---|
| | | | | | | | Melting point (°C.)* | | Effective degree of | Orienta- | | degree | | | |
| Example | Ethylene content (mol %) | Treating agent | Acid catalyst | pH | Temperature (°C.) | Rate of reaction (%) | Before cross-linking | After cross-linking | cross-linking (%) | tion coefficient | Change in hand | of exhaustion (%) | Degree of dyeing | L* | Light fastness |
| 7 | 32 | TMN | A.A. | 3.8 | 135 | 70 | 182 | 195 | 15.1 | 0.158 | good | 83 | good | 12.5 | 5–4 |
| | 32 | TMN | F.A. | 2.5 | 135 | 75 | 182 | 197 | 17.4 | 0.159 | good | 80 | good | 12.6 | 4 |
| | 32 | TMN | S.A. | 2.0 | 135 | 80 | 182 | 200 | 20.9 | 0.177 | good | 81 | good | 13.1 | 4 |
| | 32 | TMN | A.A. | 4.6 | 135 | 65 | 182 | 194 | 13.9 | 0.181 | good | 85 | good | 12.1 | 5 |
| 8 | 32 | TMN | A.A. | 3.8 | 135 | 60 | 182 | 200 | 20.9 | 0.104 | excel | 79 | good | 13.1 | 5–4 |
| | 32 | TMN | F.A. | 2.5 | 135 | 65 | 182 | 203 | 24.3 | 0.095 | excel | 75 | good | 13.0 | 4 |
| | 32 | TMN | S.A. | 2.0 | 135 | 70 | 182 | 206 | 27.8 | 0.066 | good | 73 | good | 13.3 | 4 |
| | 32 | TMN | A.A. | 4.6 | 135 | 65 | 182 | 194 | 13.9 | 0.188 | excel | 80 | good | 12.8 | 5 |
| 9 | 32 | BEN | F.A. | 2.5 | 135 | 83 | 182 | 205 | 26.7 | 0.053 | good | 78 | good | 12.8 | 4–5 |

*Melting point of ethylene-vinyl alcohol copolymer as one component of the composite fiber.
TMN: tetramethoxynonane
BEN: 1,1,9,9-bisethylenedioxynonane
A.A.: acetic acid
F.A.: formic acid
S.A.: sulfuric acid

Example 10

The same procedure as in Example 8 was repeated except that the ethylene-vinyl alcohol copolymer was replaced by the one containing 44 mol % ethylene and the acid catalyst was replaced by maleic acid. The dyed fabric underwent dry heat treatment at 160° C. for final setting. The results are shown in Table 3.

Examples 11 and 12

The same procedure as in Example 10 was repeated except that 1,1,9,9-bisethylenedioxynonane (5 g/liter) was used as the acetalizing agent. The results are shown in Table 3.

Example 13

The same procedure as in Example 9 was repeated except that maleic acid was used as the acid catalyst and the treating temperature was changed to 130° C. The results are shown in Table 3.

Examples 14 to 16

A composite fiber of layer splitable type was prepared from component A (for 6 layers) and component B (for 5 layers) defined below, with the ratio of A/B being 2/1.

Component A: Ethylene-vinyl alcohol copolymer (in the form of chips), containing 44 mol % ethylene and having a degree of saponification of 99% and a melting point of 165° C.

Component B: Polyethylene terephthalate (in the form of chips), having an intrinsic viscosity of 0.62, measured at 30° C. in a 1/1 phenol/tetrachloroethane mixture (by weight). The spinning temperature was 250° C. and the winding speed was 1000 m/min.

The spun filaments were drawn three times in the usual way by using a hot roll (at 75° C.) and a hot plate (at 140° C.). Thus there was obtained a composite multifilament yarn, 50 denier/24 filaments.

A 2/1 twill weave was woven from this yarn as the warp and weft. The woven fabric was scoured at 80° C. dried at 110° C., and preset at 155° C. The preset fabric was treated

TABLE 3

| | | Acetal decomposition regeneration reaction | | | | | | | | | Evaluation of dyed fabric | | | | |
|---|---|---|---|---|---|---|---|---|---|---|---|---|---|---|---|
| | | | | | | | Melting point (°C.)* | | Effective degree of | Orienta- | | degree | | | |
| Example | Ethylene content (mol %) | Treating agent | Catalyst | pH | Temperature (°C.) | Rate of reaction (%) | Before cross-linking | After cross-linking | cross-linking (%) | tion coefficient | Change in hand | of exhaustion (%) | Degree of dyeing | L* | Light fastness |
| 10 | 44 | TMN | M.A. | 2.4 | 120 | 80 | 165 | 183 | 20.9 | 0.108 | excel | 78 | good | 13.9 | 5–4 |
| 11 | 44 | BEN | M.A. | 2.4 | 120 | 80 | 165 | 183 | 20.9 | 0.073 | excel | 82 | good | 13.6 | 6–4 |
| 12 | 44 | BEN | M.A. | 1.8 | 125 | 90 | 165 | 182 | 19.7 | 0.008 | excel | 86 | good | 13.0 | 4 |
| 13 | 32 | BEN | M.A. | 2.4 | 130 | 95 | 183 | 205 | 26.7 | 0.014 | excel | 88 | good | 12.8 | 5–4 |

*Melting point of ethylene-vinyl alcohol copolymer as one component of the composite fiber.
TMN: tetramethoxynonane
BEN: 1,1,9,9-bisethylenedioxynonane
M.A.: maleic acid with sodium hydroxide (20 g/liter) at 90° C. for reduction and division to give a fabric of microfine structure.

The resulting fabric was dipped in a solution (specified below) for dyeing and acetal decomposition regeneration reaction, followed by reduction and washing and drying.

The dyed fabric was evaluated. The results are shown in Table 4.

Treating solution

Treating agent:

| | |
|---|---|
| 1,1,9,9-bisethylenediozynonane | 15% owf |
| "Labasion" | 0.5 g/liter |

from Matsumoto Yushi Seiyaku Co., Ltd. (containing sodium dodecylbenzenesufonate as an active ingredient)

Dye stuff:DIANIX BLUE BG-FS 200 NEW 15% owf (pH adjusted with acetic acid, sulfuric acid, or maleic acid.)

Bath ratio: 50:1

40 minutes at 115° C. (liquor stream at high temperatures)

Reduction and washing

| | |
|---|---|
| hydrosulfite: | 1 g/liter |
| sodium hydroxide | 1 g/liter |
| "Amirdine D" | 1 g/liter |

(from Dai-ichi Kogyo Seiyaku Co., Ltd.)

20 minutes at 80° C.

Comparative Examples 10 to 12

The same procedure as in Example 14 was repeated except that the acid catalyst, pH, and treating temperature were changed as shown in Table 4. The results of evaluation of the dyed fabric are shown in Table 4.

It is noted that the acid catalyst in excessively high concentrations causes the excessive shrinkage of fiber, making the woven fabric too stiff to be of practical use. It is also noted that the excessively high treating temperature makes the fiber amorphous and causes the excessive fiber, making the fabric stiff and poor in hand.

Component A: Ethylene-vinyl alcohol copolymer (in the form of chips), containing 44 mol % ethylene and having a degree of saponification of 99% and a melting point of 165° C.

Component B: Polyethylene terephthalate (in the form of chips), having an intrinsic viscosity of 0.65. The two components were melted by separate extruders and the melts were mixed by a static mixer (two-division, 6-element) so that the melts were mixed in layers. The mixture was spun from the spinneret. The fibers were wound at a speed of 900 m/min.

The spun fibers were drawn 2.62 times by using a first bath at 75° C. and a second bath at 85° C. Thus there was obtained a 3-denier fiber. This fiber was crimped in the usual way and then cut into staple fibers, 3-denier, 54 mm.

This staple fibers was made into a card web, with a weight of 100 g/m$^2$, and the card web underwent interlacing by water jet. The fibers were easily split into fibrils by the high-pressure water stream (80 kg/cm$^2$). (Marked fibrillation by laminar splitting did not occur in the stage of forming the card web.) After drying at 100° C., there was obtained a non-woven fabric composed of interlaced fibrils.

The non-woven fabric underwent crosslinking and dyeing simultaneously in the same manner as in Example 16. (Dyeing was carried out at 115° C. for 40 minutes.) The dyed fabric underwent raising and finish setting at 165° C. Thus there was obtained a shammy non-woven fabric having soft hand.

This non-woven fabric is superior in resistance to steam ironing and repeated industrial washing and is suitable for use as a durable wiper with good water absorption.

As mentioned above, the present invention provides a fiber of ethylene-vinyl alcohol copolymer which is superior in resistance to steam ironing, and also provide a composite fiber containing said copolymer as one component which can be dyed without any problem with the working environment and permits good color development without discoloration. The composite fiber can be made into a fabric which is superior in resistance to steam ironing and is suitable for use as garments and living materials.

What is claimed is:

1. A fiber of crosslinked ethylene-vinyl alcohol copolymer containing 25–70 mol % ethylene, characterized in that the effective degree of cross-linking (K%) represented by equation (1) below satisfies equation (2) below.

TABLE 4

| Example (Comparative Example) | Ethylene content (mol %) | Acetal decomposition regeneration reaction: Treating agent | Acid catalyst | pH | Temperature (°C.) | Rate of reaction (%) | Melting point (°C.): Before crosslinking | After crosslinking | Effective degree of crosslinking (%) | Orientation coefficient | Hand |
|---|---|---|---|---|---|---|---|---|---|---|---|
| 14 | 44 | BEN | Acetic acid | 4.5 | 115 | 75 | 165 | 179 | 16.3 | 0.189 | good |
| 15 | 44 | BEN | Formic acid | 1.5 | 115 | 90 | 165 | 190 | 29.1 | 0.035 | good |
| 16 | 44 | BEN | Maleic acid | 2.0 | 115 | 85 | 165 | 183 | 21.0 | 0.087 | Good |
| (10) | 44 | BEN | Acetic acid | 5.5 | 90 | 20 | 165 | 176 | 13.0 | 0.250 | sticking |
| (11) | 44 | BEN | Maleic acid | 2.0 | 145 | 95 | 165 | — | — | — | stiffening* |
| (12) | 44 | BEN | Sulfuric acid | 0.5 | 115 | 95 | 165 | — | — | — | stiffening** |

BEN: 1,1,9,9-bisethylenedioxynonane

*due to change into amorphous state and excessive shrinkage thereby.

**due to excessive shrinkage.

Example 17

A composite fiber of layered type was prepared from component A and component B defined below, with the ratio of A/B being 1/1.

$$K(\%)=1.2\times\{(27+m)/35\}\times(T_{mk}-T_{mo}) \quad (1)$$

where, m denotes the number of linear methylene groups and/or methine groups in the crosslinked moiety;

$T_{mk}$ denotes the melting point (°C.) of the fiber of ethylene-vinyl alcohol copolymer measured after crosslinking, and $T_{mo}$ denotes the melting point (°C.) of the fiber of ethylene-vinyl alcohol copolymer measured before crosslinking.

$$K(\%) \geqq 0.27X+4.9 \quad (2)$$

where, x denotes the ethylene content (in mol %).

2. A fiber of ethylene-vinyl alcohol copolymer as defined in claim 1, which is characterized by that the orientation coefficient defined by equation (4) below is 0.19 or less, $$\text{Orientation coefficient}=2(1-D)/(D+2) \quad (4)$$

where D denotes the ratio of the integrated intensity of PAS of polarized light perpendicular to the fiber axis to the integrated intensity of PAS of polarized light parallel to the fiber axis.

3. A composite fiber of ethylene-vinyl alcohol copolymer containing 25–70 mol % ethylene and any other thermoplastic polymer, said ethylene-vinyl alcohol copolymer being characterized in that the effective degree of crosslinking (K %) represented by equation (1) below satisfies equation (2) below, with said copolymer forming part of the fiber surface, $$K(\%)=1.2\times\{(27+m)/35\}\times(T_{mk}-T_{mo}) \quad (1)$$

where, m denotes the number of linear methylene groups and/or methine groups in the crosslinked moiety;

$T_{mk}$ denotes the melting point (°C.) of the fiber of ethylene-vinyl alcohol copolymer measured after crosslinking; and $T_{mo}$ denotes the melting point (°C.) of the fiber of ethylene-vinyl alcohol copolymer measured before crosslinking.

$$K(\%) \geqq 0.27X+4.9 \quad (2)$$

where, x denotes the ethylene content (in mol %).

4. A composite fiber as defined in claim 3, wherein the ethylene-vinyl alcohol copolymer is characterized by that the orientation coefficient defined by equation (4) below is 0.19 or less, $$\text{Orientation coefficient}=2(1-D)/(D+2) \quad (4)$$

where D denotes the ratio of the integrated intensity of PAS of polarized light perpendicular to the fiber axis to the integrated intensity of PAS of polarized light parallel to the fiber axis.

5. A process for producing a fiber of ethylene-vinyl alcohol copolymer, said process comprising treating a fiber of ethylene-vinyl alcohol copolymer containing 25–70 mol % ethylene with a solution containing at least one species of the compound represented by formula (3) below in an acid condition of pH 1.0–5.0 at a temperature of 100° C. to 140° C. under pressure,

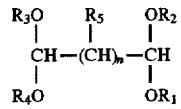

(3)

where $R_1$, $R_2$, $R_3$, and $R_4$ each denotes an alkyl group, or $R_1$ together with $R_2$ and $R_3$ together with $R_4$ form rings for alkylene groups, $R_5$ denotes hydrogen or an alkyl group, and n is a numeral in the range of 2 to 10, ($R_1$, $R_2$, $R_3$, $R_4$, and $R_5$ may have substituent groups.)

6. A process for treating a composite fiber, said process comprising treating a composite fiber of ethylene-vinyl alcohol copolymer containing 25–70 mol % ethylene and any other thermoplastic polymer, said copolymer forming part of the fiber surface, with a solution containing at least one species of the compound represented by formula (3) below in an acid condition of pH 1.0–5.0 at a temperature of 100° C. to 140° C. under pressure,

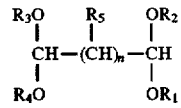

(3)

where $R_1$, $R_2$, $R_3$, and $R_4$ each denotes an alkyl group, or $R_1$ together with $R_2$ and $R_3$ together with $R_4$ form rings for alkylene groups, $R_5$ denotes hydrogen or an alkyl group, and n is a numeral in the range of 2 to 10, ($R_1$, $R_2$, $R_3$, $R_4$, and $R_5$ may have substituent groups.)

7. A process for dyeing a composite fiber of ethylene-vinyl alcohol copolymer containing 25–70 mol % ethylene and any other thermoplastic polymer, said copolymer forming part of the fiber surface, said process comprising dyeing said composite fiber simultaneously with treating it with a solution containing at least one species of the compound represented by formula (3) below in an acid condition of pH 1.0–5.0 at a temperature of 100° C. to 140° C. under pressure,

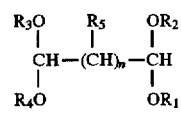

(3)

where $R_1$, $R_2$, $R_3$, and $R_4$ each denotes an alkyl group, or $R_1$ together with $R_2$ and $R_3$ together with $R_4$ form rings for alkylene groups, $R_5$ denotes hydrogen or an alkyl group, and n is a numeral in the range of 2 to 10, ($R_1$, $R_2$, $R_3$, $R_4$, and $R_5$ may have substituent groups.)

* * * * *